US010289043B2

(12) United States Patent
Iwamoto

(10) Patent No.: US 10,289,043 B2
(45) **Date of Patent: *May 14, 2019**

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Satoshi Iwamoto, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/128,570

(22) Filed: Sep. 12, 2018

(65) Prior Publication Data

US 2019/0011862 A1 Jan. 10, 2019

Related U.S. Application Data

(63) Continuation of application No. 15/641,447, filed on Jul. 5, 2017, now Pat. No. 10,101,693, which is a continuation of application No. 14/865,336, filed on Sep. 25, 2015, now Pat. No. 9,727,009.

(51) Int. Cl.
*G03G 15/20* (2006.01)

(52) U.S. Cl.
CPC ..... *G03G 15/2039* (2013.01); *G03G 15/2042* (2013.01); *G03G 15/2046* (2013.01); *G03G 2215/2032* (2013.01)

(58) Field of Classification Search
CPC ..... G03G 15/2039; G03G 15/2042; G03G 15/2046; G03G 2215/2032
See application file for complete search history.

(56) References Cited

U.S. PATENT DOCUMENTS

| | | | |
|---|---|---|---|
| 8,027,608 | B2 | 9/2011 | Mukai et al. |
| 8,135,292 | B2 | 3/2012 | Chang |
| 2003/0190170 | A1 | 10/2003 | Hamada et al. |
| 2006/0204266 | A1 | 9/2006 | Watabe |

(Continued)

OTHER PUBLICATIONS

Non-Final Office Action for U.S. Appl. No. 14/865,336 dated Jan. 21, 2016.

(Continued)

*Primary Examiner* — David M. Gray
*Assistant Examiner* — Michael A Harrison
(74) *Attorney, Agent, or Firm* — Amin, Turocy & Watson LLP

(57) ABSTRACT

According to one embodiment, a fixing device includes a heat roller, a first heat generating body, a second heat generating body, and a power adjuster. The heat roller heats a conveyed sheet. The first heat generating body is provided in the heat roller and generates heat in the vicinity of the center in the length direction of the heat roller. The second heat generating body is provided in the heat roller and generates heat in the vicinities of both the ends in the length direction of the heat roller. The power adjuster applies thinning control to electric energy supplied to one or both of the first heat generating body and the second heat generating body.

10 Claims, 8 Drawing Sheets

(56) References Cited

U.S. PATENT DOCUMENTS

| | | | | |
|---|---|---|---|---|
| 2010/0158555 | A1* | 6/2010 | Ota | G03G 15/2042 399/69 |
| 2013/0195490 | A1 | 8/2013 | Iritani | |

OTHER PUBLICATIONS

Final Office Action for U.S. Appl. No. 14/865,336 dated Jul. 28, 2016.
Non-Final Office Action for U.S. Appl. No. 14/865,336 dated Nov. 18, 2016.
Non-Final Office Action for U.S. Appl. No. 15/641,447 dated Oct. 16, 2017.

* cited by examiner

FIXING DEVICE AND IMAGE FORMING APPARATUS

CROSS-REFERENCE TO RELATED APPLICATIONS

This application is a Continuation of application Ser. No. 15/641,447 filed on Jul. 5, 2017, which is a Continuation of application Ser. No. 14/865,336 filed on Sep. 25, 2015, the entire contents of both of which are incorporated herein by reference.

FIELD

Embodiments described herein relate generally to a fixing device and an image forming apparatus.

BACKGROUND

In control of a heat source of a fixing unit in an image forming apparatus, there has been a problem of a reduction in overshoot of a surface temperature. The image forming apparatus heats a toner fixing surface to raise the temperature of the toner fixing surface to a target temperature and stops the heating at temperature lower than the target temperature. Such control makes it possible to reduce overshoot of the temperature of the toner fixing surface.

If a narrow sheet is used, there is a portion not in contact with the sheet on the toner fixing surface. In the portion, temperature easily rises in the heating. On the other hand, in a portion in contact with the sheet on the toner fixing surface, temperature less easily rises in the heating. Therefore, the temperature of the entire toner fixing surface sometimes cannot be kept uniform.

DETAILED DESCRIPTION

In general, according to one embodiment, a fixing device includes a heat roller, a first heat generating body, a second heat generating body, and a power adjuster. The heat roller heats a conveyed sheet. The first heat generating body is provided in the heat roller and generates heat in the vicinity of the center in the length direction of the heat roller. The second heat generating body is provided in the heat roller and generates heat in the vicinities of both the ends in the length direction of the heat roller. The power adjuster applies thinning control to electric energy supplied to one or both of the first heat generating body and the second heat generating body.

Figure 1:
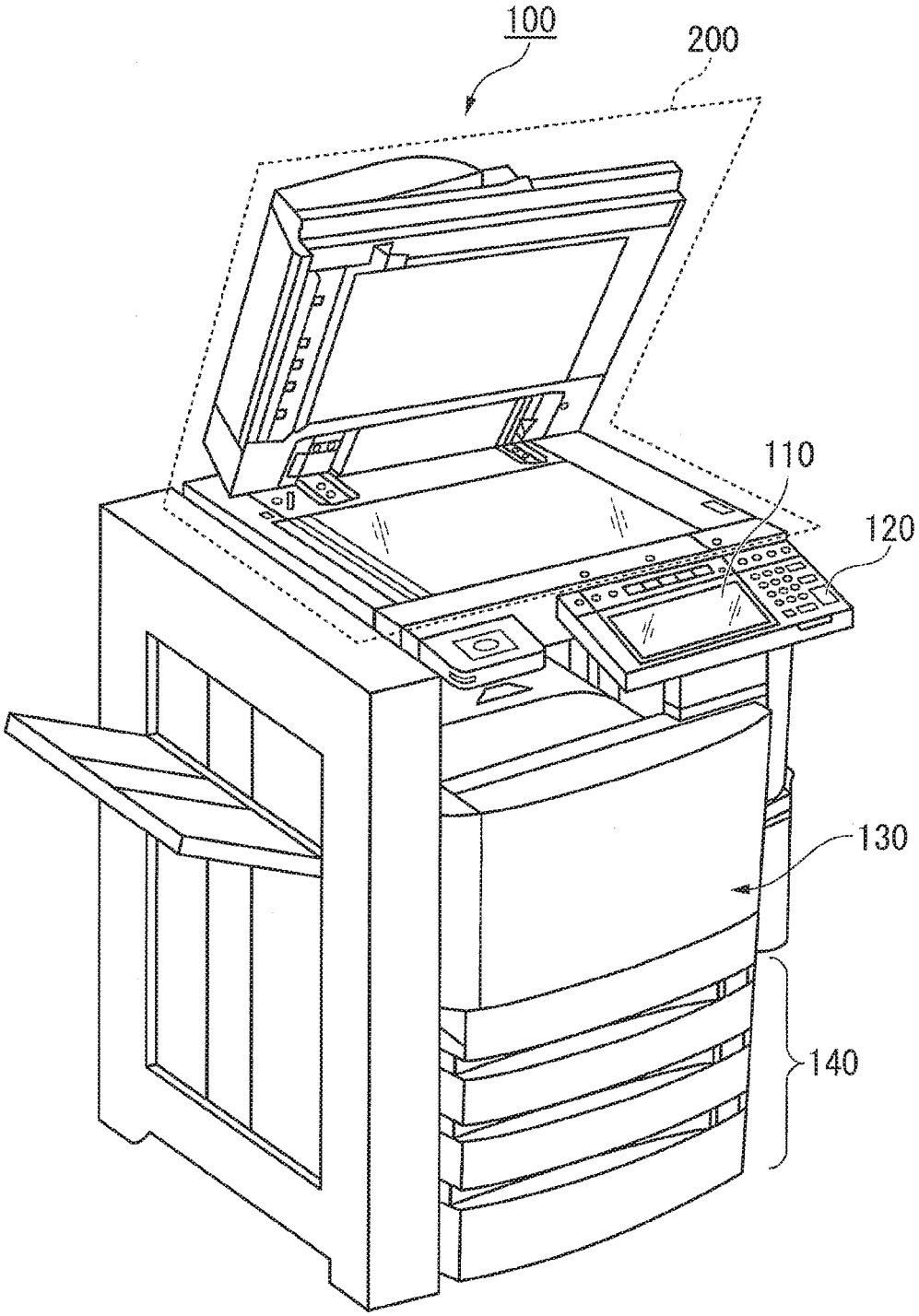
FIG. 1 is an external view showing an overall configuration example of an image forming apparatus in an embodiment.

FIG. 1 is an external view showing an overall configuration example of an image forming apparatus 100 in an embodiment. The image forming apparatus 100 is, for example, a multifunction peripheral. The image forming apparatus 100 includes a display 110, a control panel 120, a printer section 130, a sheet storing section 140, and an image reading section 200. Note that the printer section 130 of the image forming apparatus 100 may be a device that fixes a toner image or a device of an inkjet type.

The image forming apparatus 100 forms an image on a sheet using a developer such as toner. The sheet is, for example, paper or a label sheet. The sheet may be anything as long as the image forming apparatus 100 can form an image thereon.

The display 110 is an image display device such as a liquid crystal display or an organic EL (Electro Luminescence) display. The display 110 displays various kinds of information concerning the image forming apparatus 100.

The control panel 120 includes a plurality of buttons. The control panel 120 receives operation of a user. The control panel 120 outputs a signal corresponding to the operation performed by the user to a controller of the image forming apparatus 100. Note that the display 110 and the control panel 120 may be configured as an integral touch panel.

The printer section 130 forms an image on the sheet on the basis of image information generated by the image reading section 200 or image information received via a communication path. The printer 130 forms an image by performing, for example, processing explained below. An image forming unit of the printer section 130 forms an electrostatic latent image on a photoconductive drum on the basis of the image information. The image forming unit of the printer section 130 forms a visible image by depositing a developer on the electrostatic latent image. One of specific examples of the developer is toner. A transfer unit of the printer section 130 transfers the visible image onto the sheet. A fixing unit of the printer section 130 heats and pressurizes the sheet to thereby fix the visible image on the sheet. Note that the sheet on which the image is formed may be a sheet stored in the sheet storing section 140 or may be a manually fed sheet.

The sheet storing section 140 stores sheets used for the image formation in the printer section 130.

The image reading section 200 reads reading target image information as contrast of light. The image reading section 200 records the read image information. The recorded image information may be transmitted to another information processing apparatus via a network. The recorded image information may be formed as an image on the sheet by the printer section 130.

Figure 2:
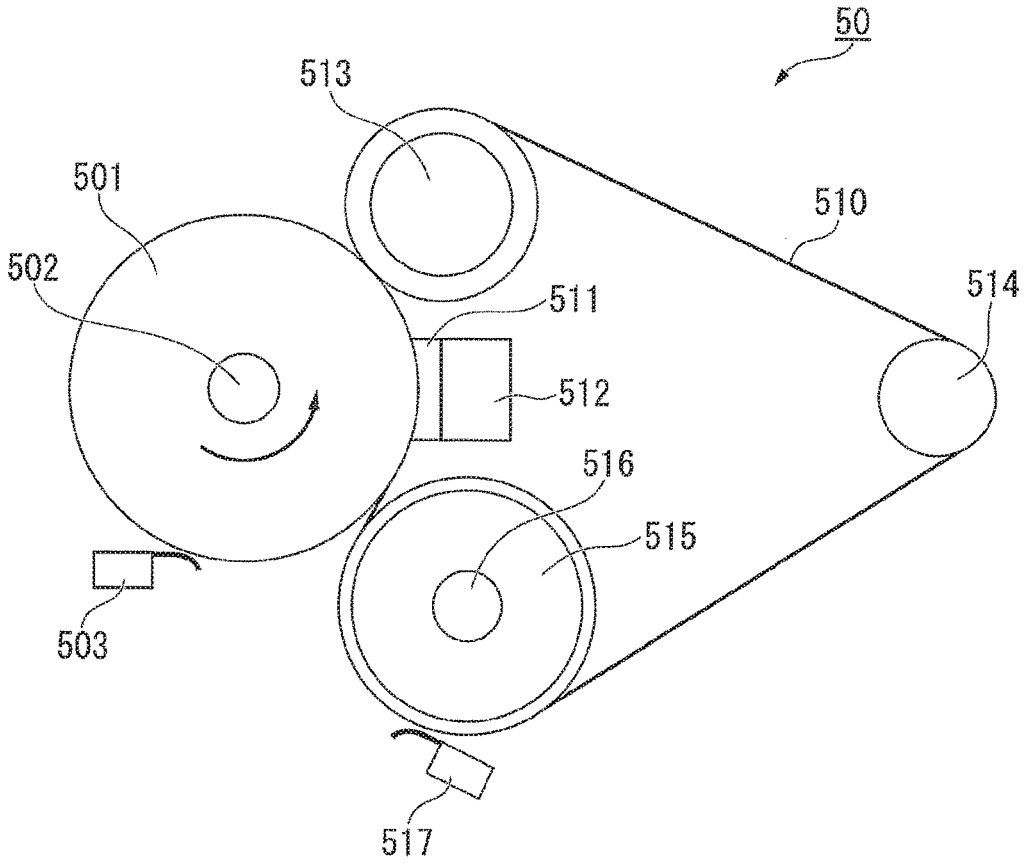
FIG. 2 is a schematic diagram showing a configuration example of a fixing unit of a printer section.

FIG. 2 is a schematic diagram showing a configuration example of a fixing unit 50 of the printer section 130. The fixing device 50 includes a heat roller 501, an HR lamp 502, an HR thermistor 503, a pressurizing belt 510, a pressurizing pad 511, a pad holder 512, a pressurizing roller 513, a tension roller 514, a belt heat roller 515, a pressurizing belt lamp 516, and a pressurizing thermistor 517.

The heat roller 501 is a fixing member formed in a cylindrical shape. The HR lamp 502 is provided on the inside of the heat roller 501. The HR lamp 502 generates heat to thereby heat the heat roller 501. The HR thermistor 503 measures the surface temperature of the heat roller 501. The diameter of the heat roller 501 is, for example, 45 mm.

The pressurizing belt 510 is held by the pressurizing roller 513, the tension roller 514, and the belt heat roller 515. The pressurizing belt 510 is brought into pressurized contact with the heat roller 501 by the pressurizing pad 511 and the pressurizing roller 513. A fixing nip portion is formed between the pressurizing belt 510 and the heat roller 501 by this pressurized contact.

The pressurizing pad 511 is held in a state in which the pressurizing pad 511 is in pressurized contact with the heat roller 501 via the pressurizing belt 510. The width of the pressurizing pad 511 is, for example, 10 mm. The pad holder 512 holds the pressurizing pad 511 in a state in which the pressurizing pad 511 is in pressurized contact with the heat roller 501.

The pressurizing roller 513 is disposed downstream in a conveying direction of the sheet. The pressurizing roller 513 brings the pressurizing belt 510 into pressurized contact with the heat roller 501. An exit of the fixing nip portion is formed by the pressurizing roller 513. The diameter of the pressurizing roller 513 is, for example, 18 mm. The tension roller 514 is disposed in a position away from the pressurizing roller 513 and the belt heat roller 515 to thereby apply tension to the pressurizing belt 510. The belt heat roller 515 is disposed upstream in the conveying direction of the sheet. The belt heat roller 515 is formed in a hollow cylindrical shape. The pressurizing belt lamp 516 is provided on the inside of the belt heat roller 515. The pressurizing belt lamp 516 generates heat to heat the belt heat roller 515. The pressurizing belt lamp 516 is configured using, for example, a halogen lamp. The pressurizing thermistor 517 measures the surface temperature of the pressurizing belt 510 near the belt heat roller 515. The diameter of the belt heat roller 515 is, for example, 20 mm.

Figure 3:
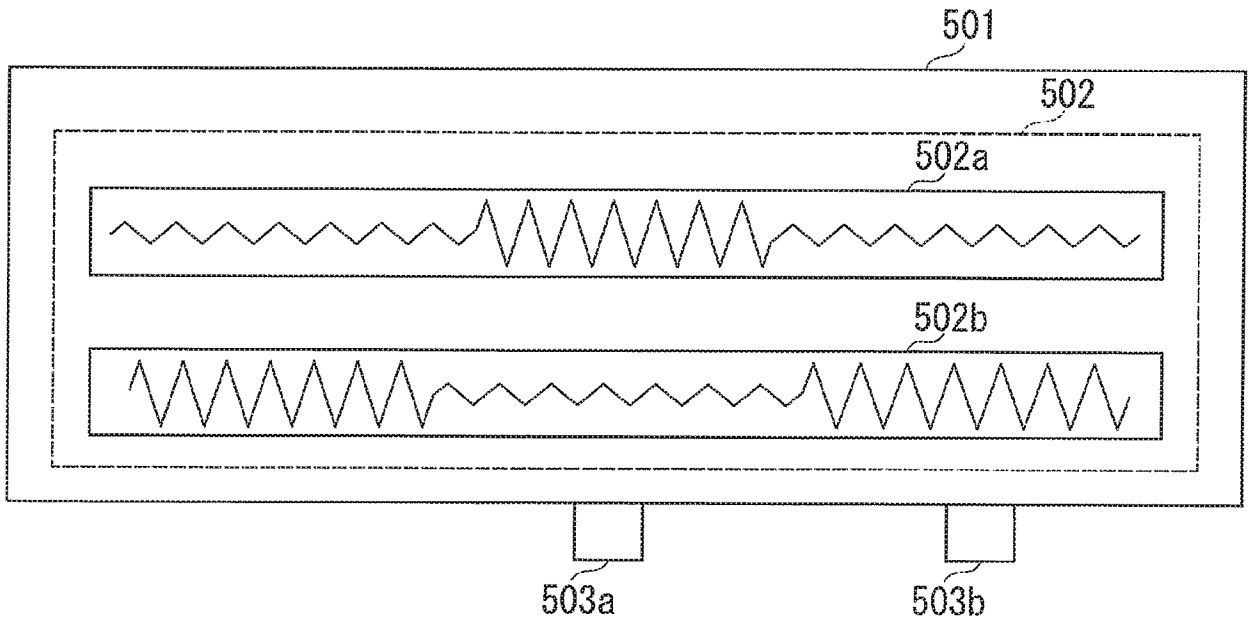
FIG. 3 is a diagram showing details of a heating mechanism of the fixing unit.

FIG. 3 is a diagram showing details of a heating mechanism of the fixing unit 50. The HR lamp 502 includes a plurality of heat generating bodies. The HR lamp 502 in this embodiment includes a center lamp 502*a* and a side lamp 502*b*. Both of the center lamp 502*a* and the side lamp 502*b* are configured using heat generating bodies such as halogen lamps.

The center lamp 502*a* includes a heat generating unit in the vicinity of the center in the length direction of the heat roller 501. The center lamp 502*a* generates heat to thereby heat the vicinity of the center in the length direction of the heat roller 501. The side lamp 502*b* includes heat generating units in the vicinities of both the ends in the length direction of the heat roller 501. The side lamp 502*b* generates heat to thereby heat the vicinities of both the ends in the length direction of the heat roller 501.

The center lamp 502*a* includes the heat generating unit having, for example, width substantially the same as the sheet width of the A4 portrait size. The side lamp 502*b* includes the heat generating units, for example, in positions corresponding to the vicinities of both the ends of a sheet of the A4 landscape size. The center lamp 502*a* and the side lamp 502*b* may be configured using lamps having the same power (e.g., 300 W). The center lamp 502*a* and the side lamp 502*b* may be configured using lamps having different powers.

The HR thermistor 503 includes a plurality of thermistors. In this embodiment, the HR thermistor 503 includes a center thermistor 503*a* and a side thermistor 503*b*. The center thermistor 503*a* is disposed in the vicinity of the center in the length direction of the heat roller 501. For example, the center thermistor 503*a* is disposed in a position corresponding to a luminous intensity distribution peak position of the center lamp 502*a*. The center thermistor 503*a* measures the surface temperature in the vicinity of the center in the length direction of the heat roller 501. The side thermistor 503*b* is disposed in the vicinity of one end in the length direction of the heat roller 501. For example, the side thermistor 503*b* is disposed in a position corresponding to a luminous intensity distribution peak position of the side lamp 502*b*. The side thermistor 503*b* measures the surface temperature in the vicinity of one end in the length direction of the heat roller 501.

Figure 4:
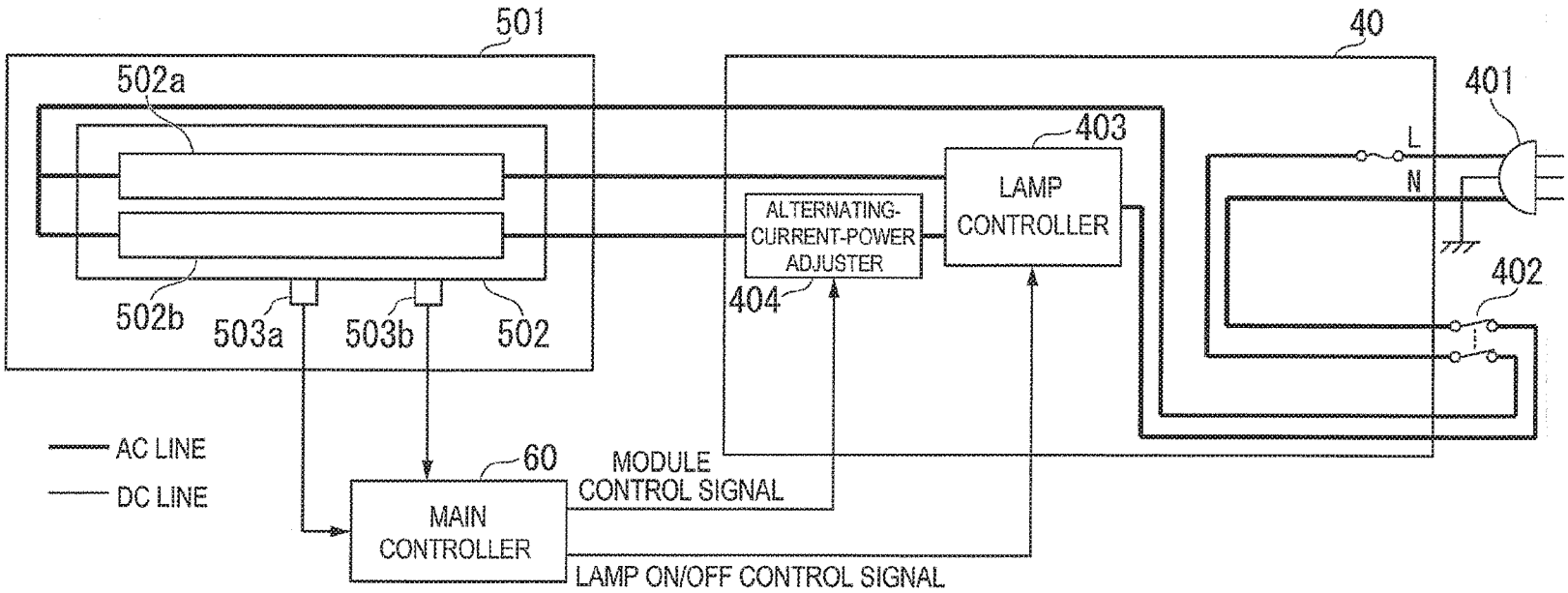
FIG. 4 is a schematic diagram showing a power supply of the image forming apparatus.

FIG. 4 is a schematic diagram showing a power supply of the image forming apparatus 100. The image forming apparatus 100 includes a switching power supply 40 and a main controller 60. The switching power supply 40 supplies alternating-current power to the functions (e.g., the HR lamp 502) of the image forming apparatus 100. The switching power supply 40 includes a plug 401, a power switch 402, a lamp controller 403, and an alternating-current-power adjuster 404.

The plug 401 is connected to a plug receiver. The plug receiver is, for example, a socket or a tap. The plug 401 supplies alternating-current power to the switching power supply 40 via the plug receiver. The power switch 402 is a switch for controlling ON and OFF of supply of alternating-current power from the plug 401 to the functional units. The lamp controller 403 controls ON and OFF of the center lamp 502*a* and the side lamp 502*b*. If the main controller 60 outputs a control signal indicating ON of the HR lamp 502, the lamp controller 403 controls the center lamp 502*a* and the side lamp 502*b* to be ON. If the main controller 60 outputs a control signal indicating OFF of the HR lamp 502, the lamp controller 403 controls the center lamp 502*a* and the side lamp 502*b* to be OFF. The alternating-current-power adjuster 404 controls ON and OFF at a cycle shorter than a cycle of the control of the lamp controller 403. With such control, the alternating-current-power adjuster 404 adjusts alternating-current electric energy per time supplied to the side lamp 502*b*. The alternating-current-power adjuster 404 receives a control signal concerning the alternating-current electric energy from the main controller 60. The alternating-current-power adjuster 404 adjusts, on the basis of a control signal output from the main controller 60, the alternating-current electric energy per time supplied to the side lamp 502*b*.

The main controller 60 receives a measurement result from the HR thermistor 503 (the center thermistor 503*a* and the side thermistor 503*b*). The main controller 60 outputs a control signal to the lamp controller 403 and the alternating-current-power adjuster 404 on the basis of the measurement result. For example, if the measurement result falls below a lamp ON temperature, the main controller 60 controls a lamp corresponding to the thermistor, which outputs the measurement result, to be ON. In this case, the main controller 60 outputs, to the lamp controller 403, a control signal for controlling the lamp corresponding to the thermistor, which outputs the measurement result, to be ON. For example, if the measurement result exceeds a lamp OFF temperature, the main controller 60 controls the lamp corresponding to the thermistor, which outputs the measurement result, to be OFF. In this case, the main controller 60 outputs, to the lamp controller 403, a control signal for controlling the lamp corresponding to the thermistor, which outputs the measurement result, to be OFF. For example, if image formation is performed on a sheet having width smaller than a predetermined threshold, the main controller 60 executes thinning control for alternating-current power supplied to the side lamp 502*b*. The main controller 60 determines a thinning amount of the alternating-current power according to time in which the sheet continuously passes the fixing unit 50 (hereinafter referred to as "paper passing time"). The main controller 60 sets the thinning amount smaller as the paper passing time is shorter. That is, the main controller 60 performs control to supply larger electric energy to the side thermistor 503*b* as the paper passing time is shorter. The main controller 60 sets the thinning amount larger as the paper passing time is longer. That is, the main controller 60 performs control to supply smaller electric energy to the side thermistor 503*b* as the paper passing time is longer.

Figures 5A, 5B, 5C, 5D:
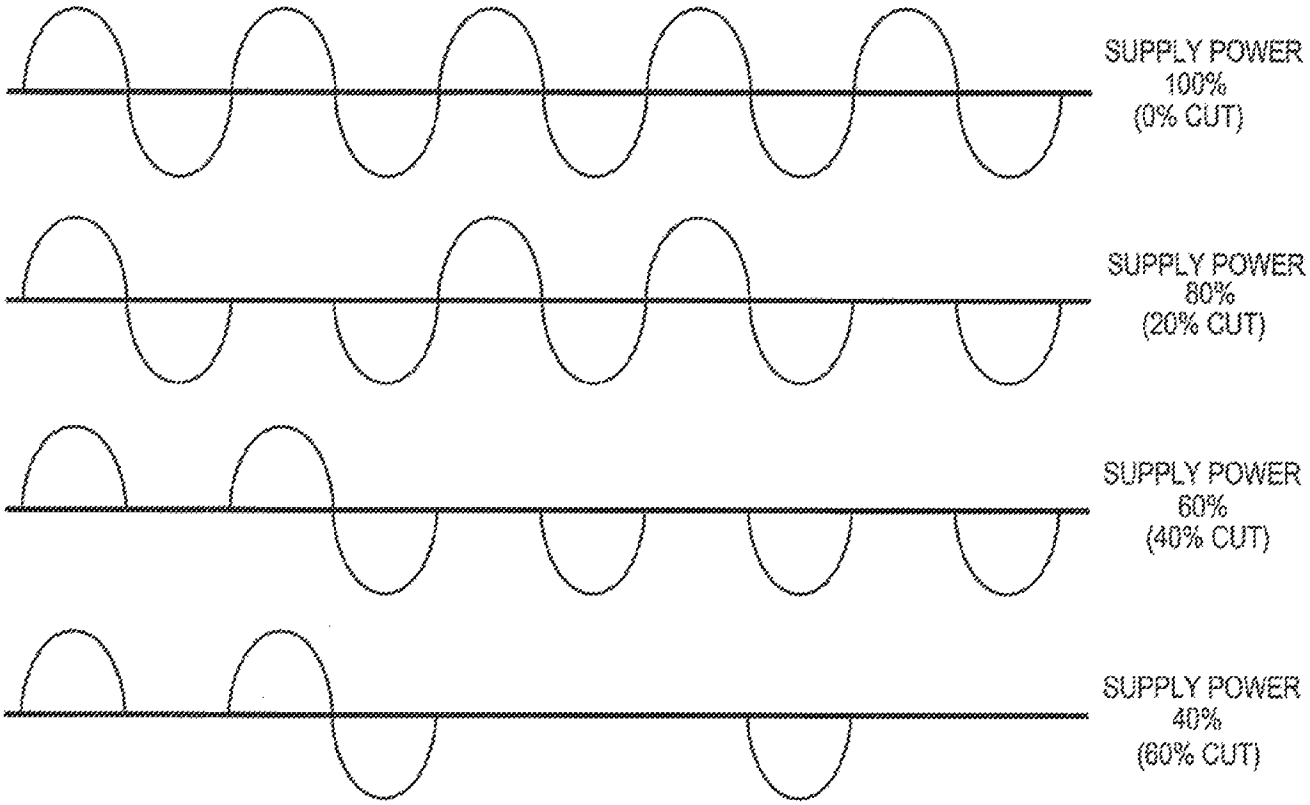
FIG. 5A is a diagram showing a temporal change of supply power in a state in which thinning control is not performed (a state of 100% supply)
FIG. 5B is a diagram showing a temporal change of supply power in a state in which the thinning control of 20% is performed (a state of 80% supply)
FIG. 5C is a diagram showing a temporal change of supply power in a state in which the thinning control of 40% is performed (a state of 60% supply)
FIG. 5D is a diagram showing a temporal change of supply power in a state in which the thinning control of 60% is performed (a state of 40% supply)

FIGS. 5A to 5D are schematic diagrams showing the operation of the alternating-current-power adjuster 404. The alternating-current-power adjuster 404 adjusts electric energy supplied to the side lamp 502*b* by, for example, subjecting the supply of the alternating-current power to the thinning control. FIG. 5A is a diagram showing a temporal change of supply power in a state in which thinning control is not performed (a state of 100% supply). In the state of 100% supply, the supply of the electric power is continuously performed.

FIG. 5B is a diagram showing a temporal change of supply power in a state in which the thinning control of 20% is performed (a state of 80% supply). In the state of 80% supply, the supply of the electric power is partially cut. Specifically, the supply of the alternating-current power is stopped for time equivalent to 20% in total in a predetermined time. As the time in which the supply of the alternating-current power is stopped, time equivalent to 20% is not continuously provided but time equivalent to less than 20% is intermittently provided a plurality of times.

FIG. 5C is a diagram showing a temporal change of supply power in a state in which the thinning control of 40% is performed (a state of 60% supply). In the state of 60% supply, the supply of electric power is partially cut. Specifically, the supply of the alternating-current power is stopped for time equivalent to 40% in total in a predetermined time. As the time in which the supply of the alternating-current power is stopped, time equivalent to 40% is not continuously provided but time equivalent to less than 40% is intermittently provided a plurality of times.

FIG. 5D is a diagram showing a temporal change of supply power in a state in which the thinning control of 60% is performed (a state of 40% supply). In the state of 40% supply, the supply of electric power is partially cut. Specifically, the supply of the alternating-current power is stopped for time equivalent to 60% in total in a predetermined time. As the time in which the supply of the alternating-current power is stopped, time equivalent to 60% is not continuously provided but time equivalent to less than 60% is intermittently provided a plurality of times.

Figure 6:
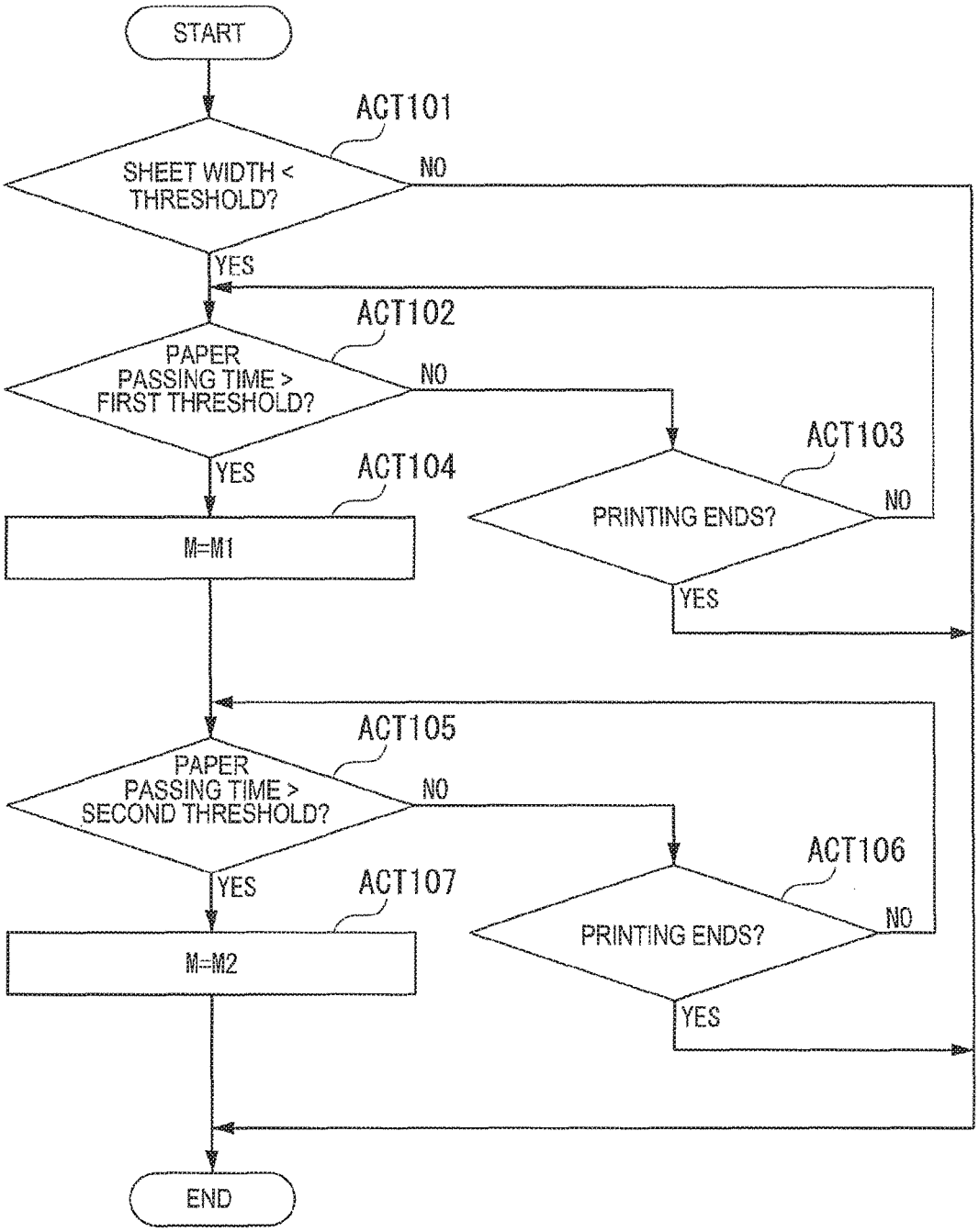
FIG. 6 is a flowchart for explaining an example of a flow of the thinning control by a main controller.

FIG. 6 is a flowchart for explaining an example of a flow of the thinning control by the main controller 60. First, the main controller 60 determines whether the width of a sheet on which an image is formed is smaller than a predetermined threshold (ACT 101). If the width of the sheet is larger than the predetermined threshold (NO in ACT 101), the main controller 60 does not execute the thinning control. In this case, the main controller 60 outputs, to the alternating-current-power adjuster 404, a control signal indicating that alternating-current power is supplied 100%. On the other hand, if the width of the sheet is smaller than the predetermined threshold (YES in ACT 101), the main controller 60 determines whether a paper passing time is larger than a first threshold. If the paper passing time is smaller than the first threshold (NO in ACT 102), the main controller 60 determines whether printing ends (ACT 103). If the printing does not end (NO in ACT 103), the main controller 60 returns to the processing in ACT 102. If the printing ends (YES in ACT 103), the main controller 60 ends the control.

If the paper passing time is larger than the first threshold (YES in ACT 102), the main controller 60 determines that a thinning amount M is a value M1 set in advance according to the first threshold. The main controller 60 outputs, to the alternating-current-power adjuster 404, according to the determination, a control signal indicating that the thinning control of alternating-current electric energy is performed with the thinning amount M1. Thereafter, the main controller 60 determines whether the paper passing time is larger than the second threshold. The second threshold is larger than the first threshold. If the paper passing time is smaller than the second threshold (NO in ACT 105), the main controller 60 determines whether printing ends (ACT 106). If the printing does not end (NO in ACT 106), the main controller 60 returns to the processing in ACT 105. If the printing ends (YES in ACT 106), the main controller 60 ends the control.

If the paper passing time is larger than the second threshold (YES in ACT 105), the main controller 60 determines that the thinning amount M is a value M2 set in advance according to the second threshold. M2 is larger than M1. Alternating-current electric energy supplied to the side thermistor 503*b* if the thinning control is performed with the thinning amount M2 is smaller than the alternating-current electric energy supplied if the thinning control is performed with the thinning amount M1. The main controller 60 outputs, to the alternating-current-power adjuster 404, according to the determination, a control signal indicating that the thinning control of alternating-current electric energy is performed with the thinning amount M2.

Figure 7:
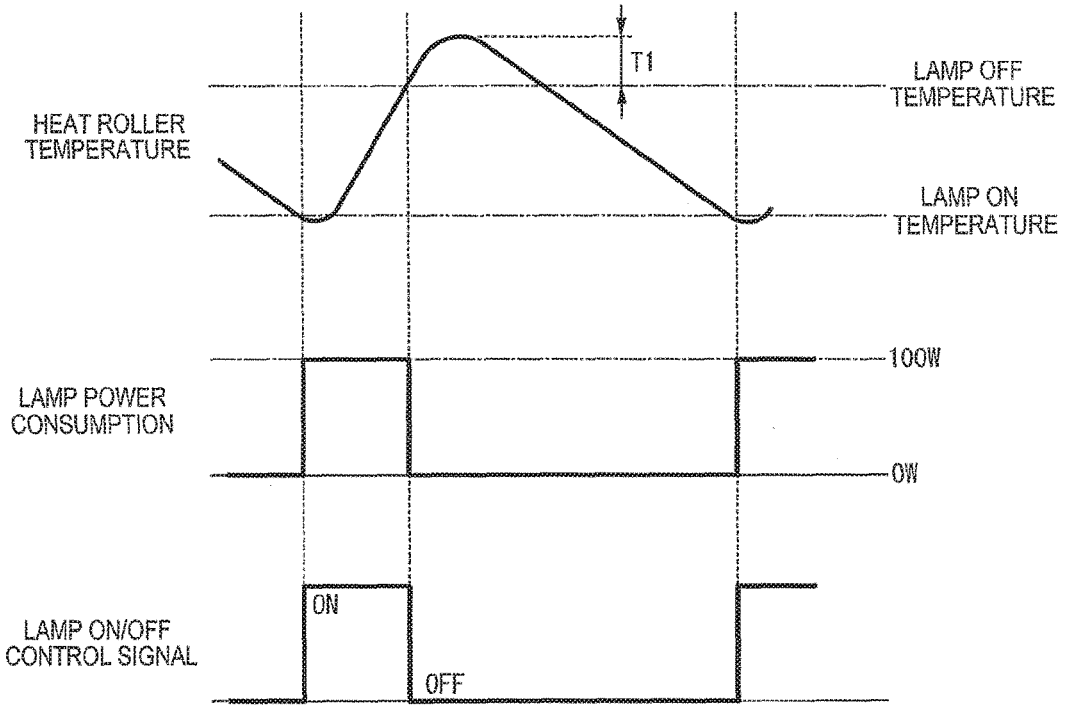
FIG. 7 is a diagram showing a temperature change of a heat roller that occurs if the thinning control is not performed.

FIG. 7 is a diagram showing a temperature change of the heat roller 501 that occurs if the thinning control is not performed. If the thinning control is not performed, electric power of 100% (e.g. 100 W) is supplied to the side lamp 502*b* while the side lamp 502*b* is controlled to be ON. The side lamp 502*b* continues heating with power consumption of 100 W. If a measurement result of the side thermistor 503*b* exceeds the lamp OFF temperature, the main controller 60 controls the side thermistor 503*b* to be OFF. Even after the side thermistor 503*b* is controlled to be OFF, the heat roller 501 is heated by heat remaining in the side lamp 502*b*. Therefore, so-called overshoot occurs. In FIG. 7, the temperature of the overshoot is T1.

Figure 8:
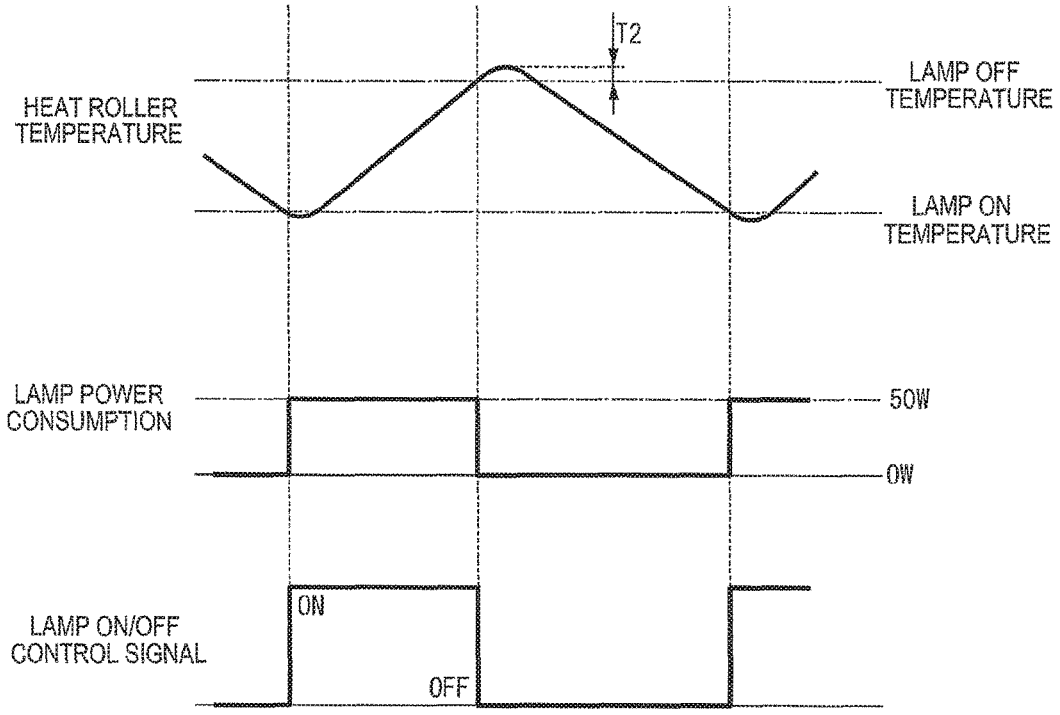
FIG. 8 is a diagram showing a temperature change of the heat roller that occurs if the thinning control is performed.

FIG. 8 is a diagram showing a temperature change of the heat roller 501 that occurs if the thinning control is performed. If the thinning control is performed, electric power smaller than 100% (e.g. 50%; 50 W) is supplied to the side lamp 502*b* while the side lamp 502*b* is controlled to be ON. The side lamp 502*b* continues heating with power consumption of 50 W. If a measurement result of the side thermistor 503*b* exceeds the lamp OFF temperature, the main controller 60 controls the side thermistor 503*b* to be OFF. Even after the side thermistor 503*b* is controlled to be OFF, the heat roller 501 is heated by heat remaining in the side lamp 502*b*. However, alternating-current electric energy supplied to the side lamp 502*b* is small compared with alternating-current electric energy supplied if the thinning control is not performed. Therefore, the temperature of the overshoot is T1 lower than T2.

In the image forming apparatus 100 configured as explained above, alternating-current electric energy supplied to the HR lamp 502 is subjected to the thinning control. Therefore, it is possible to reduce overshoot that occurs in the heat roller 501.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A fixing device comprising:

a heat roller configured to heat a conveyed sheet;

a first heat generating body provided in the heat roller and configured to generate heat in a vicinity of a center in a longitudinal direction of the heat roller;

a second heat generating body provided in the heat roller and configured to generate heat in vicinities of both ends in the longitudinal direction of the heat roller;

a power adjuster configured to apply, in a process of image formation, thinning control to electric energy supplied to the second heat generating body only and not to apply thinning control to electric energy supplied to the first heat generating body; and a controller configured to control the power adjuster to adjust a thinning amount of electric power to be a single predetermined value according to a first threshold, when a cumulative value of continuous sheet conveyance time is larger than the first threshold.

2. The device according to claim 1, wherein the controller determines, according to width of the conveyed sheet, whether the thinning control in the power adjusting section is executed.

3. The device according to claim 1, wherein the controller determines that the thinning control in the power adjuster is executed if width of the conveyed sheet is smaller than a predetermined width.

4. The device according to claim 1, wherein the first heat generating body and second heat generating body are halogen lamps.

5. The device according to claim 1, wherein the power adjuster is configured to cut partially the electric power to be supplied to the second heat generating body.

6. An image forming apparatus comprising:

a heat roller configured to heat a conveyed sheet;

a first heat generating body provided in the heat roller and configured to generate heat in a vicinity of a center in a longitudinal direction of the heat roller;

a second heat generating body provided in the heat roller and configured to generate heat in vicinities of both ends in the longitudinal direction of the heat roller;

a power adjuster configured to apply, in a process of image formation, thinning control to electric energy supplied to the second heat generating body only and not to apply thinning control to electric energy supplied to the first heat generating body; and a controller configured to control the power adjuster to adjust a thinning amount of electric power to be a single predetermined value according to a first threshold, when a cumulative value of continuous sheet conveyance time is larger than the first threshold.

7. The apparatus according to claim 6, wherein the power adjuster is configured to cut partially the electric power to be supplied to the second heat generation body.

8. The apparatus according to claim 6, wherein the controller determines, according to width of the conveyed sheet, whether the thinning control in the power adjusting section is executed.

9. The apparatus according to claim 6, wherein the controller determines that the thinning control in the power adjuster is executed if width of the conveyed sheet is smaller than a predetermined.

10. The apparatus according to claim 1, wherein the first heat generating body and second heat generating body are halogen lamps.

* * * * *